United States Patent [19]

Tiepel et al.

[11] 4,008,171

[45] Feb. 15, 1977

[54] VOLUME REDUCTION OF SPENT RADIOACTIVE ION EXCHANGE RESIN

[75] Inventors: Erich W. Tiepel, Export; Pang K. Lee, Pittsburgh; Arnold S. Kitzes, Pittsburgh; Donald L. Grover, McMurray, all of Pa.

[73] Assignee: Westinghouse Electric Corporation, Pittsburgh, Pa.

[22] Filed: Sept. 10, 1973

[21] Appl. No.: 395,803

[52] U.S. Cl. ..... 252/301.1 W

[51] Int. Cl.$^2$ ..... G21F 9/30

[58] Field of Search ..... 252/301.1 W; 210/24, 210/26, 20, 175; 260/2.2 R

[56] References Cited

UNITED STATES PATENTS

| | | | |
|---|---|---|---|
| 2,855,371 | 10/1958 | Abrams | 260/2.2 R |
| 3,479,295 | 11/1969 | Thompson | 252/301.1 W |
| 3,791,981 | 2/1974 | Calmon | 252/301.1 W |

OTHER PUBLICATIONS

"Drying" Kirk–Othmer Encyclopedia of Chemical Tech. Interscience Publishers, New York, 1965, vol. 7, pp. 332–334ff.

*Primary Examiner*—Benjamin R. Padgett
*Assistant Examiner*—Deborah L. Kyle
*Attorney, Agent, or Firm*—J. R. Campbell; Z. L. Dermer

[57] ABSTRACT

A process for reducing the volume of spent radioactive ion exchange resins which have been used for conditioning water circulated through a nuclear reactor. The spent resins are discharged from the reactor system as radioactive wastes to a spent resin storage tank in the form of a slurry. The slurry is first vacuum dewatered to remove the free water and then the intrinsic water in the wet resin beads is removed by drying in a vacuum fluidized bed chamber utilizing superheated steam which also acts to fluidize the bed. Further drying is accomplished by spraying the partially dried resin and superheated steam through a steam injected two-fluid nozzle for further extraction of intrinsic water from the resins. The steam is discharged to a condenser and the dried resins to an evacuated disposal drum. Approximate 4:1 volume reductions from the resin-water slurry to the dried resin is obtainable by practicing the process.

5 Claims, 2 Drawing Figures

VOLUME REDUCTION OF SPENT RADIOACTIVE ION EXCHANGE RESIN

BACKGROUND OF THE INVENTION

Ion exchange resins are conventionally used in various nuclear reactor collant, water make-up and other systems for removing mineral, metallic and other impurities from water circulated through the reactor and its associated components. Contrary to practices followed in commercial and domestic ion exchange systems used for conditioning water, the radioactive resins in the reactor systems usually are not regenerated, and once spent, must be disposed of as radioactive waste.

Various methods have been developed for disposing of the radioactive water and resins. Currently, the spent resins are separated from a resin-water mixture by utilizing a centrifuge which isolates the resins to eventually form a radioactive paste or cake which is disposed of in suitable containers. In those cases where disposal of the water does not take place, it is recycled to the waste process system for further use. In other system, the resin-water slurry is mixed with a fixing agent and discharged to an appropriate disposal package. In still other systems, the resin-water slurry above is discharged into an evacuated drum filled with dry cement and equipped with a screen cage insert. The slurry fills the cage and water seeps through the screen into the cement lining the cage thereby encapsulating the resin in a lining of solidified concrete.

All of these and other disposal methods are expensive because the large volume of radioactive resin and water must be contained in an appropriate receptacle to eliminate the possibility of later escape to the environment in which the receptacles are buried or stored. Moreover, substanial effort in terms of time and labor costs, and material costs, is required to carry out the processing and encapsulation of the radioactive waste products in order to comply with prevailing rules and regulations governing their disposal.

SUMMARY OF THE INVENTION

Briefly stated, the above disadvantages are eliminated by the present invention by providing a process which substantially reduces the volume of radioactive resins required to be encapsulated for disposition by removing all of the slurry water as well as the intrinsic water from the resins. The resins are subjected to a vacuum filtration process which removes the free water and the remaining wet resins are then exposed to a vacuum environment, where superheated steam injected into the evacuated resin container acts to remove the intrinsic water. Since the removed radioactive free water is sufficiently pure to permit recycling in a hold-up tank while the dried resin which shrinks about 50% during treatment, is discharged to a steel or other drum suitable for burial according to conventional practices.

An object of the invention therefore is to provide a process for reducing the volume of spent radioactive resins by subjecting a water-resin slurry to vacuum filtration to remove free water followed by vacuum dehydration to remove intrinsic water from the resins.

Another object of the invention is to provide a process for reducing the volume of spent radioactive resins by utilizing superheated steam or other fluids as a fluidizing medium thereby minimizing release of radioactive particles to the environment.

Another object of the invention is to provide a process for reducing the volume of spent radioactive resins by utilizing a superheated fluid which dries the resins and further serves to transport the resins through the volume reduction system.

Still another object of the invention is to provide a process for reducing the volume of spent radioactive resins by vacuum drying the resins to permit efficient packaging at low cost while returning water from the treatment process to systems associated with a nuclear reactor.

BRIEF DESCRIPTION OF THE DRAWING

The subject matter of the invention is particularly pointed out and distinctly claimed in the concluding portion of this specification. The invention, however, both as to organization and method of operation, together with further objects and advantages thereof, may best be understood by reference to the following description taken in connection with the accompanying drawing in which:

DESCRIPTION OF THE PREFERRED EMBODIMENT

In accordance with conventional practices conditioned water supplied to various nuclear reactor systems flows over ion-exchange materials which remove minerals, metallic ions and other foreign substances.

Figure 1:
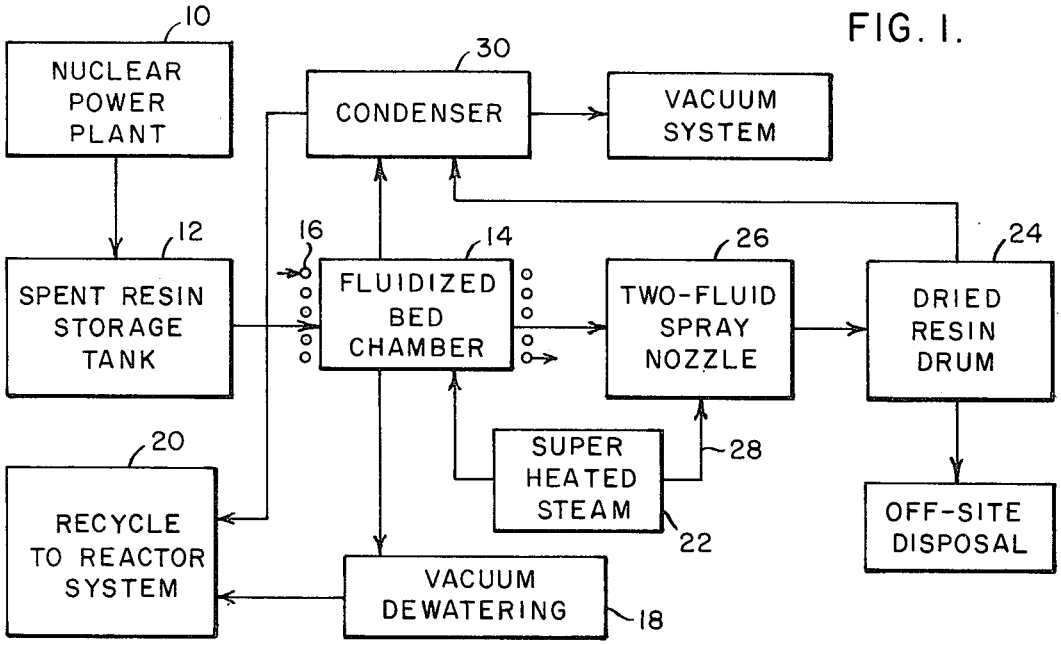
FIG. 1 is a schematic showing of the system used for reducing the volume of ion exchange resins.

Referring to the block diagram of FIG. 1, after the exchange materials become contaminated, the nuclear power plant 10 discharges the spent radioactive materials to a storage tank 12. The ion exchange material may comprise resins for example, such as nuclear grade mixed bed and cation resins of the type manufactured by Rohm and Haas, Diamond Shamrock Co., or other manufacturers, or other materials which effectively remove these types of contaminants from water. As used herein, the term resin is intended to encompass those materials which act to condition water to the purity needed for nuclear reactor purposes.

When the resin in the reactor system becomes ineffective to the point where it is considered spent, removal from the system is necessary and the resin is thus disposed of as radioactive waste. In the past, high labor and material costs were incurred for disposing of the wastes and resin together with minimizing liquid discharges from the plant, and to overcome these disadvantages, the process described herein recycles the water back to the reactor systems and reduces the volume of resin by about 50%. This is accomplished by discharging the water and resin in the form of a slurry comprising about 50% by volume free water to a fluidized bed chamber 14. The slurry desirably is needed to facilitate pumping of the resin from tank 12 to the bed chamber.

The bed chamber 14 containing the slurry is equipped with electrical or other heaters 16 mounted either inside chamber 14 or on its outer surface used for heating the chamber to a specified temperature between 40°–150° C, preferably between 70°–80° C. The chamber further is evacuated to a pressure between 15–29″ mercury although the preferred pressure is about 25″ mercury. With the chamber at its operating condition the free water around the resin beads is removed by vacuum filtration equipment 18 through the settled resin bed and discharged for recycling to the reactor hold-up tanks 20. At this point in the process, the free water has been evacuated from chamber 14 thus leaving wet resin which typically contains at least 50% internal water content.

The second step in the process comprises maintaining the vacuum in chamber 14 and then passing superheated steam from a source 22 at a temperature of 200°–500° F or higher through the wet solids to fluidize the bed. Heat therefore is transferred to the wet resin by both the superheated steam and the heaters on bed chamber 14. The fluidized bed is subjected to a vacuum and as the resin loses moisture, heat is continuously added to the fluid bed to maintain the bed temperature in a range consistent with the thermal stability of the resin to be dried.

Figure 2:
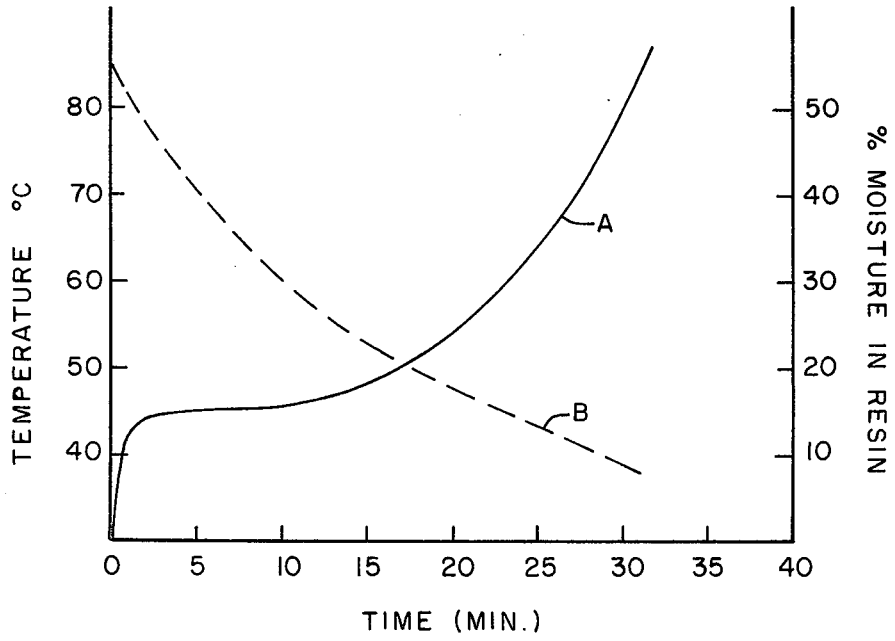
FIG. 2 is a typical resin drying curve for a bed of mixed resins.

The exposure of resin to these drying conditions results in loss of intrinsic water and such loss is determined by established drying curves for the particular resin being dried. A typical drying curve for a mixed bed resin is shown in FIG. 2. The first part of curve A is at constant temperature indicating an initial constant drying rate for the resins. As the drying rate falls off curve B, the temperature in the bed increases. This operation is continued until the desired bed temperature is achieved. Typical residence times in the fluid bed were found to be 30–60 minutes depending on the final desired resin moisture content and the rate at which heat is added to the system. When a set bed temperature is obtained the fluidizing-drying in the bed chamber is halted and the vacuum system isolated.

At the conclusion of this step, the fluid bed chamber is isolated and the resin discharged directly into an evacuated drum 24 for disposal or discharged through a two fluid spray nozzle 26 directly into the drum. To effect resin transfer through the nozzle superheated steam from source 22 transports the resin from the fluid bed chamber 16 to one inlet of the nozzle while superheated steam from source 22 is supplied through line 28 to the other inlet to the nozzle. The transporting steam as well as the superheat content of the nozzle injected steam is imparted to the resin to further remove intrinsic moisture therefrom.

After mixing and drying, the resin and steam are finally sprayed into the evacuated drum 24 and the resin at this time has reached its final stage of drying. Steam from drum 24 is discharged to condenser 30 then to hold-up tanks which are connected to the reactor liquid systems.

In the over-all drying sequence, most of the heat input is supplied by the hot walls of the feed chamber during fluidization, a smaller fraction by the superheated steam used to fluidize the resin beads and the remainder by the superheated steam during final spray drying. However these heat inputs can be adjusted to reduce time sequences or character of the final product. With the above resins used in this process, approximately 40–50% removal of water from the resins is most advantageous. Further removal of water from the resins is a comparatively slow operation requiring bed temperatures which cause some degradation of the material and long fluid bed residence times.

The water removed from the wet resins is condensed along with the fluidizing and transporting steam and sent back to the reactor liquid waste processing system. The overall volume reductions obtained in the process are normally 45–50% of the settled bed volume with maximum reductions thus far of 56% attainable. To reduce radioactive carry over of volatile species such as iodine the fluid bed chamber residence time and temperature is kept to a minimum to prevent anion resins from decomposing and thus releasing volatile species.

The above described process exhibits serveral important advantages since the process affords substantial reduction in resin disposal and operating costs while simultaneously minimizing release of radioactivity to the environment or atmosphere. The process does not generate any other contaminated waste streams, other than the water from the steam and resin which can be sent directly to the reactor liquid waste treatment system, because the process described herein and such treatment systems are all contained within closed loops. The water from the dewatering steps is of a quality that is acceptable for direct recycle to the reactor make-up tanks through a polishing demineralizer. Moreover, the components may be sized smaller than those used at commercial reactor plants and mounted on vehicles of different types and sizes. These vehicles with the installed components may then be used to service nuclear reactor plants which may desire such a disposal service.

It will be apparent that many modifications and variations may be made in light of the above teachings. It therefore is to be understood that within the scope of the appended claims, the invention may be practiced other than is specifically described.

What is claimed is:

1. A process for reducing the volume of spent radioactively contaminated ion exchange material comprising the steps of:

generating a slurry of water and ion exchange material and supplying the slurry to a fluid bed chamber;

removing the free water from said slurry thus leaving wet ion exchange material;

externally heating said chamber and the ion exchange material therein to a temperature between 40° to 150° C;

evacuating said chamber to a pressure between 15 and 29 mercury and then while maintaining said pressure and external heat, introducing superheated steam thereinto at a temperature between about 200°–500° F to remove at least a portion of the intrinsic water in said material to thereby reduce the volume of the material;

conducting the steam and said removed intrinsic water, from said chamber to a condenser; and discharging the dehydrated ion exchange material to a disposal drum.

2. The process according to claim 1 including the step of continuing to impart heat to said material at substantially constant temperature to dry the material and as the drying rate decreases, increasing the temperature of the fluidized bed of material until the moisture content in said material is further reduced to a desired value.

3. The process according to claim 2 including isolating said chamber after said desired value is reached; and introducing superheated steam into said chamber to transport the partially dried material to said drum; and removing said steam from said drum.

4. The process according to claim 3 including utilizing the superheated steam in said chamber to transport said partially dried material to said drum through a nozzle wherein the material is caused to low an additional amount of intrinsic water; and discharging steam from said drum to said condenser.

5. The process according to claim 4 including introducing a supply of superheated steam into a mixing chamber for the nozzle so that the superheat content in the transporting steam and the superheat content in the nozzle injected steam is transferred to said material to further dry it to a desired value.

* * * * *